US006012557A

United States Patent [19]

Derelanko

[11] Patent Number: 6,012,557

[45] Date of Patent: Jan. 11, 2000

[54] BRIEFCASE COMPANION BAG SYSTEM

[76] Inventor: Michael J. Derelanko, 117 Robertsville Road, Manalapan, N.J. 07726

[21] Appl. No.: 09/106,408

[22] Filed: Jun. 29, 1998

[51] Int. Cl.[7] ..... A45C 3/02; A45C 13/00; A45C 15/00

[52] U.S. Cl. ..... 190/108; 190/102; 190/110

[58] Field of Search ..... 190/102, 108, 190/110, 26; 383/37; 150/111

[56] References Cited

U.S. PATENT DOCUMENTS

| | | | |
|---|---|---|---|
| D. 227,818 | 7/1973 | Dipadova | 190/108 X |
| 523,503 | 7/1894 | Alberschardt | 190/108 |
| 922,567 | 5/1909 | Cosgrove | 190/102 X |
| 2,319,729 | 5/1943 | Ford | 190/102 |
| 2,493,506 | 1/1950 | Schwartzbard | 383/37 X |
| 2,813,602 | 11/1957 | MacArthur, Jr. | 190/108 X |
| 2,979,098 | 4/1961 | Greaves | 383/37 X |
| 3,729,038 | 4/1973 | Ekeson | 190/110 |
| 3,837,447 | 9/1974 | Honan | 190/102 X |
| 4,685,546 | 8/1987 | Sadow | 190/102 |
| 4,693,346 | 9/1987 | Eversdijk | 190/111 |
| 5,509,515 | 4/1996 | Guo | 150/111 X |
| 5,520,462 | 5/1996 | Clark | 190/102 X |

FOREIGN PATENT DOCUMENTS

| | | | |
|---|---|---|---|
| 1195440 | 11/1959 | France | 190/102 |
| 2358.124 | 2/1978 | France | 190/102 |
| 2342.895 | 3/1975 | Germany | 190/110 |
| 1485044 | 12/1976 | United Kingdom | 190/102 |
| 2257028 | 1/1993 | United Kingdom | 190/102 |

*Primary Examiner*—Sue A. Weaver
*Attorney, Agent, or Firm*—Charles I. Brodsky

[57] ABSTRACT

A carry bag system in which the handle of a briefcase, attache case, small suitcase, or overnight bag, for example, fits through an elongated slot on the flap of an accessory bag having one or more compartments for storing articles placed therein, with the accessory bag draping over one of the sides while being transported about as a single unit by virtue of the carry handle. A series of straps and buckle-snap arrangements are described to further secure the accessory bag with the main carrying unit, and with a second accessory bag carried by the briefcase, attache case, small suitcase or overnight bag in similar manner—with either or both accessory bags being additionally detachable from the combination to allow independent carrying thereof to conferences, meetings and seminars without having to carry the entire combination together.

19 Claims, 5 Drawing Sheets

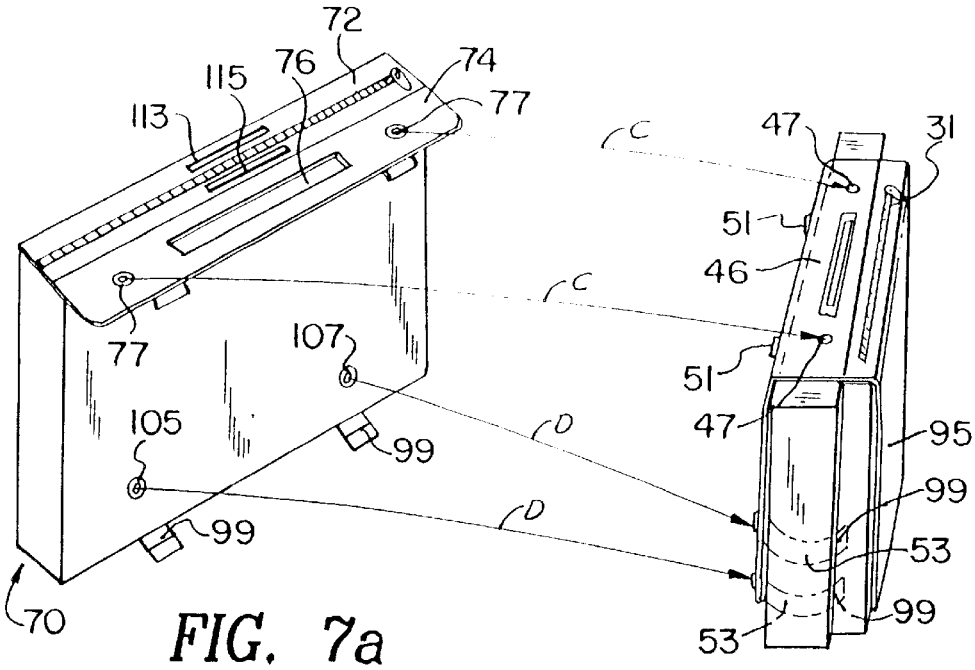
FIG. 7a
FIG. 7b
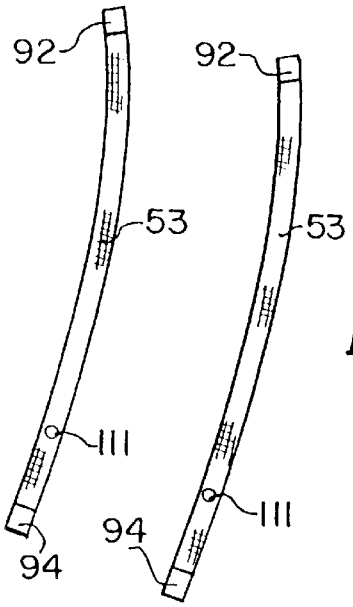
FIG. 7d
FIG. 7c
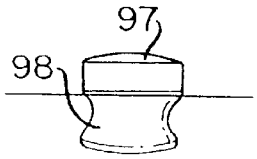
FIG. 7e
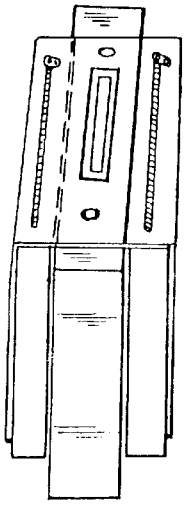
FIG. 8

BRIEFCASE COMPANION BAG SYSTEM

FIELD OF THE INVENTION

This invention relates to carry bags—whether they be of the briefcase, attache case, small suitcase, or overnight bag type, for example—in general, and to an add-on companion system for increasing the capacity of such carrying arrangements, when desired, in particular.

BACKGROUND OF THE INVENTION

As is well known and understood, the modern business traveler is continually being faced with the problem of having to carry, in addition to the standard briefcase, attache case, suitcase, or overnight bag, such items as a personal computer, electronic organizer and cellular phone—as well as binders, books and portfolios which may need to be brought along initially, or are accumulated in the course of a business trip, as are frequently collected at seminars and conferences. To make matters worse, and as will be apparent, the number of additional items to be transported can differ, one business trip from another. Thus, and as will be appreciated, the current state of affairs typically requires the business traveler to carry several cases each time, for each of these additional items, which makes transport extremely cumbersome and difficult, given the fact that only two hands are available for carrying everything. Oftentimes, as awkward as it may be, the business traveler is forced to carry more than one case in each hand, or beyond even that, carrying some of them over the shoulder or around the neck. Having such a large number of cases, then, makes it difficult to keep track of all of them to prevent forgetting one or more and leaving them behind—or, for security reasons, makes it difficult to keep track of each case in preventing its theft. Add to this the fact that in modern transportation terminals, the traveler must walk large distances in order to get to and from the boarding area and the entrance way to the facility, the present day situation leaves much to be desired.

One obvious solution is to use a very large carrying case to carry all the items necessary to take on a trip. Whether this case is then carried about by hand, wheeled about, or pulled along on rollers, such a solution is not readily practical as it requires the business traveler to remove the contents of his or her standard briefcase or attache case as used on a daily basis, and place those items in the larger suitcase. This cumbersome large case then has to be taken to each business session on the trip when a standard briefcase would be more convenient. After the traveler has returned from the trip, then those daily needed items have to again be replaced in the standard briefcase for daily use. Obviously, the use of the very large carrying case as an alternative to carrying more than one case in each hand, and/or about the shoulder or around the neck, is not a realistic solution for the person who is on the road a lot. In like vein, the business traveler might also not need the larger storage capacity at the beginning of the business trip, but might accumulate additional items during the trip which need to be transported home —initially, only a smaller carrying case would be needed, which would be easier for the traveler to take to each meeting. However, the traveler would then face the problem of how to transport the additional materials home that do not fit into the smaller case.

OBJECTS OF THE INVENTION

It is an object of the present invention, therefore, to provide a new and improved carry bag system which is especially attractive for the business traveler who, besides having the need for carrying a briefcase, attache case, small suitcase or overnight bag, is frequently faced with the predicament of having to carry more and more items along, instead of having to turn to a larger carrying case.

It is an object of the invention, also, to provide a carry system which can be added to that normally used otherwise, or removed, as the needs of the situation require.

It is another object of the present invention, to provide this added system in a manner that it can be carried about simply in one hand, without having to go through the routines of draping it over the shoulder, around the neck, or kicking it ahead, as the business traveler moves along his or her way, in going from place-to-place.

It is a further object of the invention to provide such a system in a manner as to essentially marry it to the standard briefcase, attache case, etc. employed, so as to enable the overall construction to be carried along in merged fashion with the briefcase, attache case, small suitcase, etc.

SUMMARY OF THE INVENTION

As will become apparent from the following description, the present invention comprises a companion bag system which offers a solution to the problems faced by the business traveler as outlined above. As will be seen, the companion bag is arranged to be placed on, and affixed to, the standard size briefcase, attache case, etc.—thus, allowing many items to be transported along with the briefcase, attache case, etc. using just one hand. Such companion bags will be seen to be securable to the briefcase, attache case, small suitcase, overnight bag, etc., to prevent the forgetting of one, or the other, and allows the business traveler to have all the items secured together to obviate this, and at the same time deterring theft. As will be seen from the description that follows, the companion bag arrangement is designed to be easily removed from the standard briefcase or attache case to be left—for example, in the hotel room if the business traveler wishes to use only the standard briefcase for a meeting, and then can be easily reattached if the business traveler again wishes to transport the additional items to the next event on the business trip.

As will become clear from the following description, the companion bag system can be constructed of a soft material such as vinyl, leather, or nylon, allowing it to be stored inside of a larger suitcase when not in use. As will be appreciated, this allows the business traveler who has no need to transport additional items at the beginning of the business trip, but expects to accumulate them during the course of it, in taking along an empty companion bag for use at that later time in the business trip when additional carrying space is needed. Because such bags can be designed, in accordance with the invention, with a variety of different compartment settings, a business traveler can customize the bag system for the specific storage requirements of each business trip. As will be described, where even more items are gathered to increase still further the amount of additional carrying space required, the companion bag arrangement of the invention will be seen to be one which permits two such bags to be attached together, thereby creating a system to increase storage space all the more.

As will be described below, in a preferred embodiment of the present invention a "briefcase" (understood to mean in the following description either a standard briefcase, an attache case, a small suitcase, an overnight bag, and similar such items) of generally rectangular shape and substantial thickness is utilized, having a carry handle and top, bottom, side and end walls. With it, an accessory bag is employed, also having top, bottom, side and end walls, to provide a carrying compartment for these additional articles to be placed within. In one embodiment of the invention, a flap extends from the top of the accessory bag having a slot of configuration to overlie and accept the carry handle when extended therethrough, in thus abutting one of the side walls of the accessory bag against one of the side walls of the briefcase. Means are then provided on the flap and on one of the bottom and that side wall of the accessory bag to removably secure the bag to the briefcase when carrying the briefcase about by the handle. Where the handle is of an elongated shape, then, the slot in the flap may be elongated as well, with the accessory bag being removably secured with the briefcase by any appropriate type of strap fastener, for example. Whether the strap fastening occurs through a snap or buckle arrangement, or by means of a loop-and-hook type adhesion, the accessory bag then becomes married to, and carried along with, the briefcase. Where further additional space is required, a second accessory bag can be employed, of design similar to the first accessory bag—again with its own flap and elongated slot, for example, to similarly accept the carry handle of the briefcase, but this time being removably secured with the first bag, so that the two accessory bags are then carried together along with the briefcase. In either arrangement, as will be apparent, the accessory bag can be designed to have one or more storage compartments within, if desired, to separate any items that might be needed for a meeting or conference, or picked up there as handouts or exhibits. In such manner (and regardless of the type of coupling arrangements selected to join the various auxiliary devices together), a single companion bag is then available, to be used alone or attached to a similar bag and allowing both to be hung from the briefcase—and with different designs selected for the bag construction, allows for a versatile customizable system, permitting a business traveler to pick-and-choose between different types of available accessory bags that might meet the requirements of the conference, meeting, or seminar agenda needs.

BRIEF DESCRIPTION OF THE DRAWINGS

These and other features of the present invention will be more clearly understood from a consideration of the following description, taken in connection with the accompanying drawings, in which:

FIGS. 7*a*–7*e* are views helpful in an understanding of the manner by which a pair of accessory bags may be secured together for carrying with the briefcase by its carry handle;

FIG. 8 is a side view of the arrangement of FIGS. 7*a*–7*e* with the accessory bags in place about the briefcase, but without the securing straps in position.

DETAILED DESCRIPTION OF THE INVENTION

Figure 1:
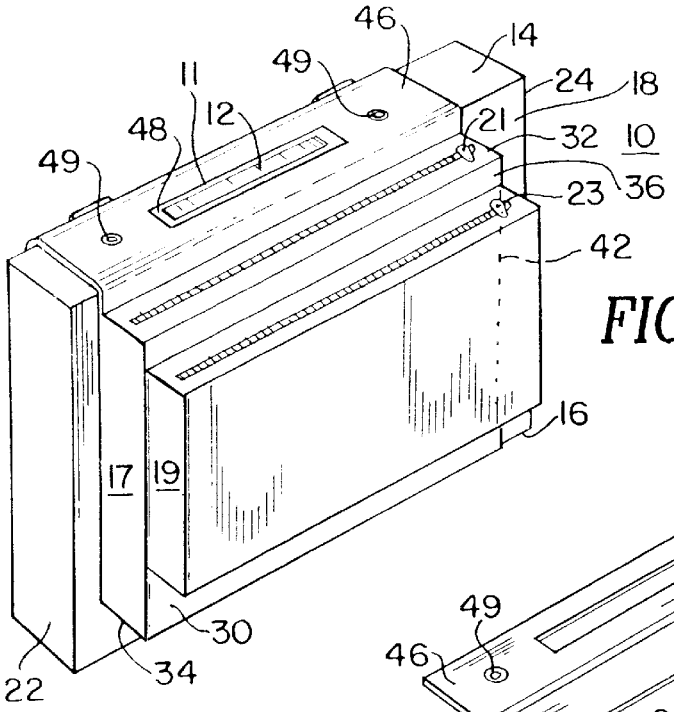
FIG. 1 is a pictorial view of a briefcase companion bag system constructed in accordance with the teachings of the present invention incorporating a briefcase and an accessory bag for carrying articles placed therein.

In the drawings, the briefcase 10 (or the attache case, small suitcase or overnight bag) is shown of generally rectangular shape and substantial thickness, having a carry handle 12 and top, bottom, side and end walls 14, 16, 18, 20, 22 and 24, respectively. An accessory bag 30 is shown, also having top, bottom, side and end walls 32, 34, 36, 38, 40 and 42, respectively. A flap 46 is shown extending from the top 32 of the bag, having an opening 48, shown as an elongated slot of configuration to overlie and accept the carry handle 12 when extending through it in abutting one of the side walls 38 against the briefcase, particularly against its side wall 18. As will be appreciated, by lifting on the carry handle 12, it serves as a "stop" to the surface 11 of the slot 48, to hold the accessory bag 30 in carrying the briefcase 10 and the accessory bag 30 as a unit. In FIG. 1, the accessory bag is shown as having two piggy-back compartments 17, 19, each with zipperable openings, as at 21, 23.

Figure 2:
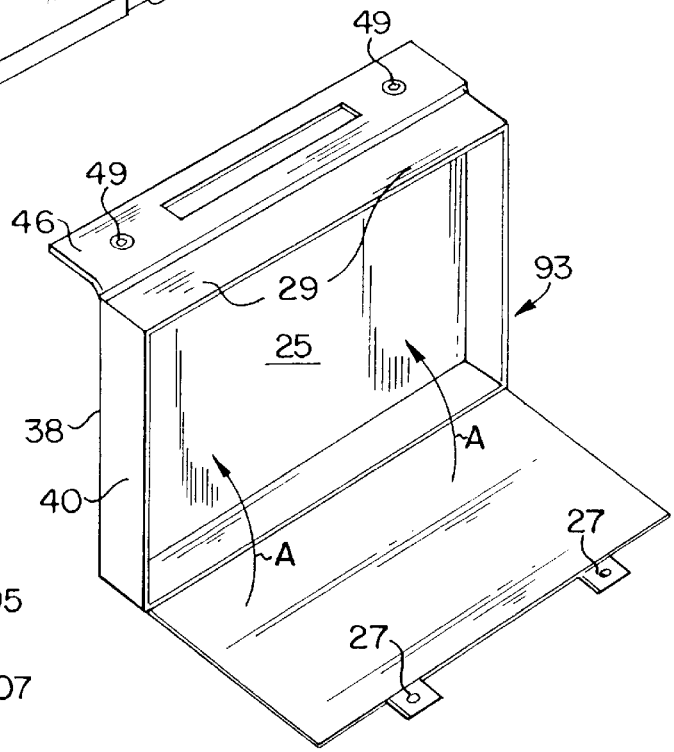
FIG. 2 pictorially illustrates a second type of accessory bag for the carrying of added articles according to the invention.

FIG. 2 shows an alternative arrangement for the accessory bag with its flap 46, as having only a single compartment 25 and a clasp opening, illustrated by the hasps 27 closing and opening with the catch 29. Rather than having the "top" opening of the compartments 21, 23 of FIG. 1, the accessory bag 93 of FIG. 2 is shown with a "side" opening closure.

Figure 3:
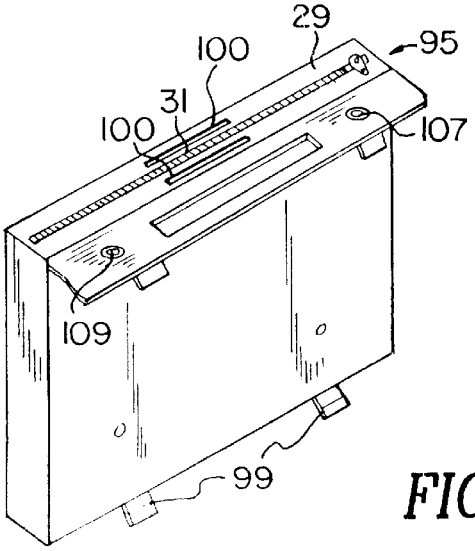
FIGS. 3–5 are views illustrating different types of accessory bags according to the invention, and are helpful in an understanding of the use of removable straps for fastening the accessory bag to the briefcase.
Figure 4:
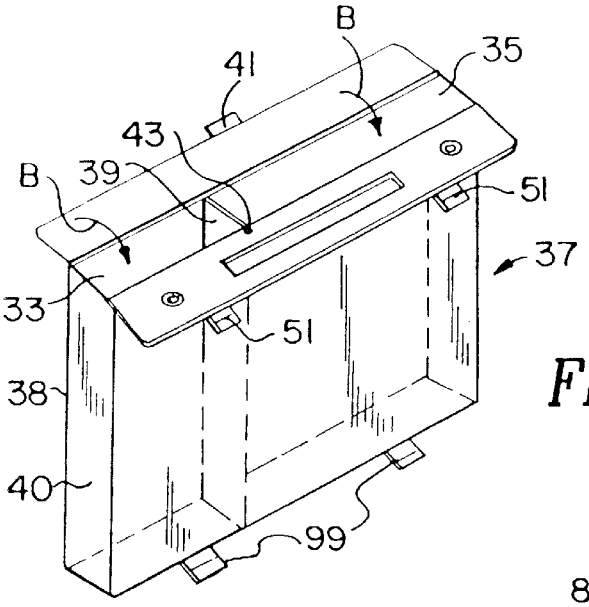
Figure 5:
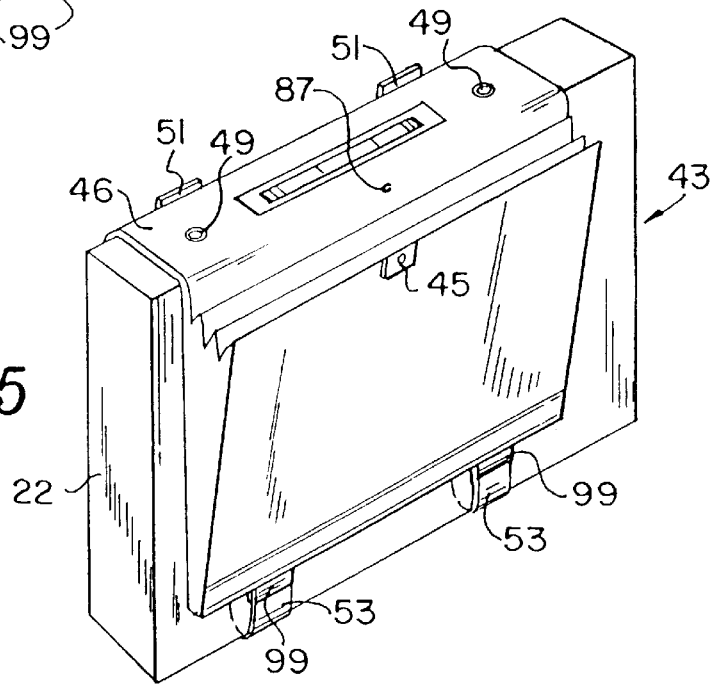

FIGS. 3–5 illustrate alternative arrangements for the accessory bag to be carried with the briefcase 10. In FIG. 3, a single compartment bag 95 with a "top" opening is illustrated, the compartment being represented by the numeral 29, and the zipper opening as 31. In FIG. 4, on the other hand, a double compartment is shown as 33, 35 in the accessory bag 37, formed by a divider wall 39—again, with a clasp closure as shown at 41, 43. As will be understood, the arrows A in FIG. 2 and B in FIG. 4 illustrate the direction of closing of the bag. FIG. 5, moreover, shows an accordion-type folder bag 43, claspably closable by means of the hasp 45 and catch 87, with separable sections.

Figure 9:
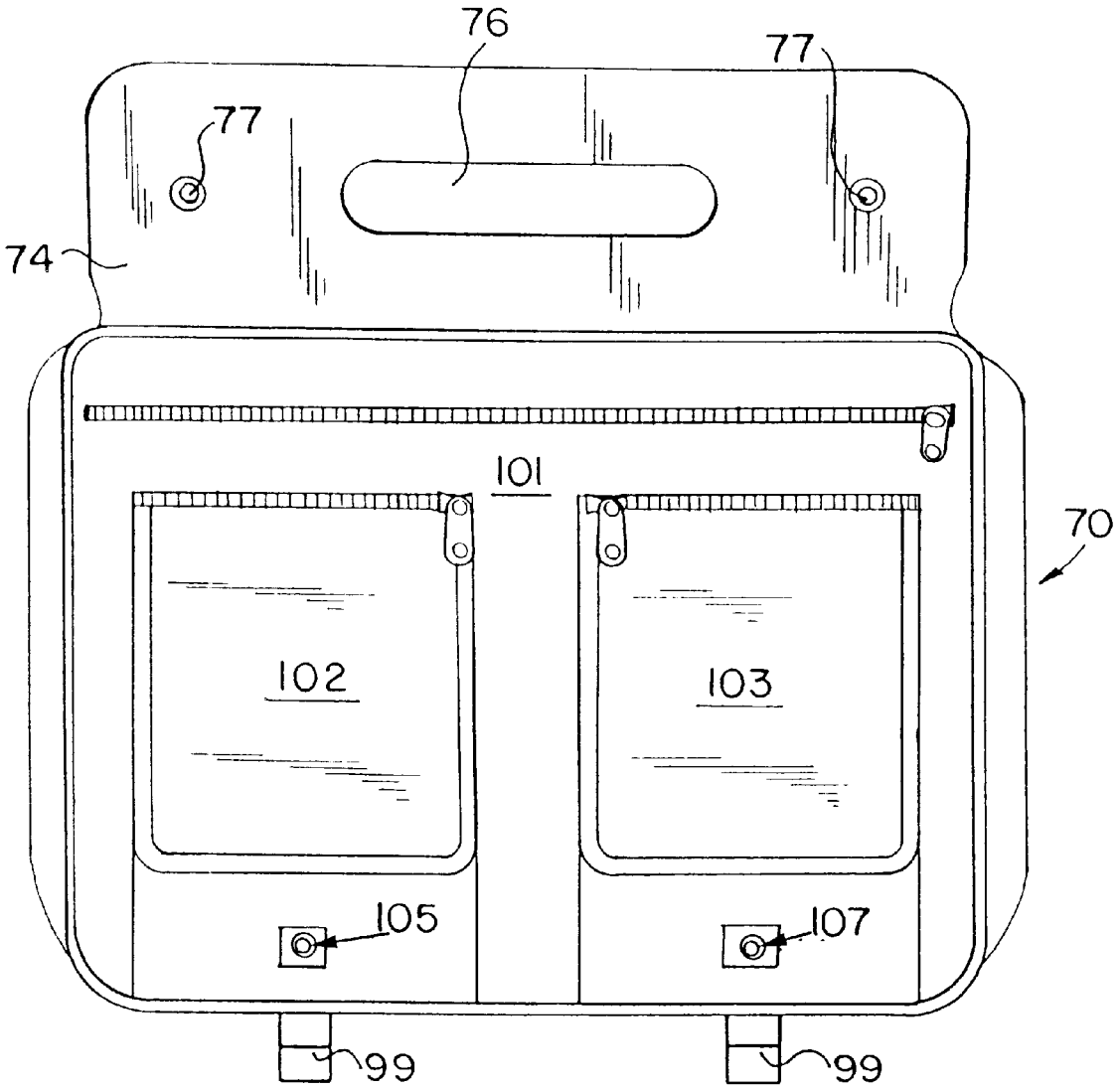
FIGS. 9 and 10 are helpful in an understanding as to the manner of coupling a second accessory bag with the briefcase to further increase the capacity of articles to be carried by the briefcase companion bag system of FIGS. 1–8.
Figure 10:
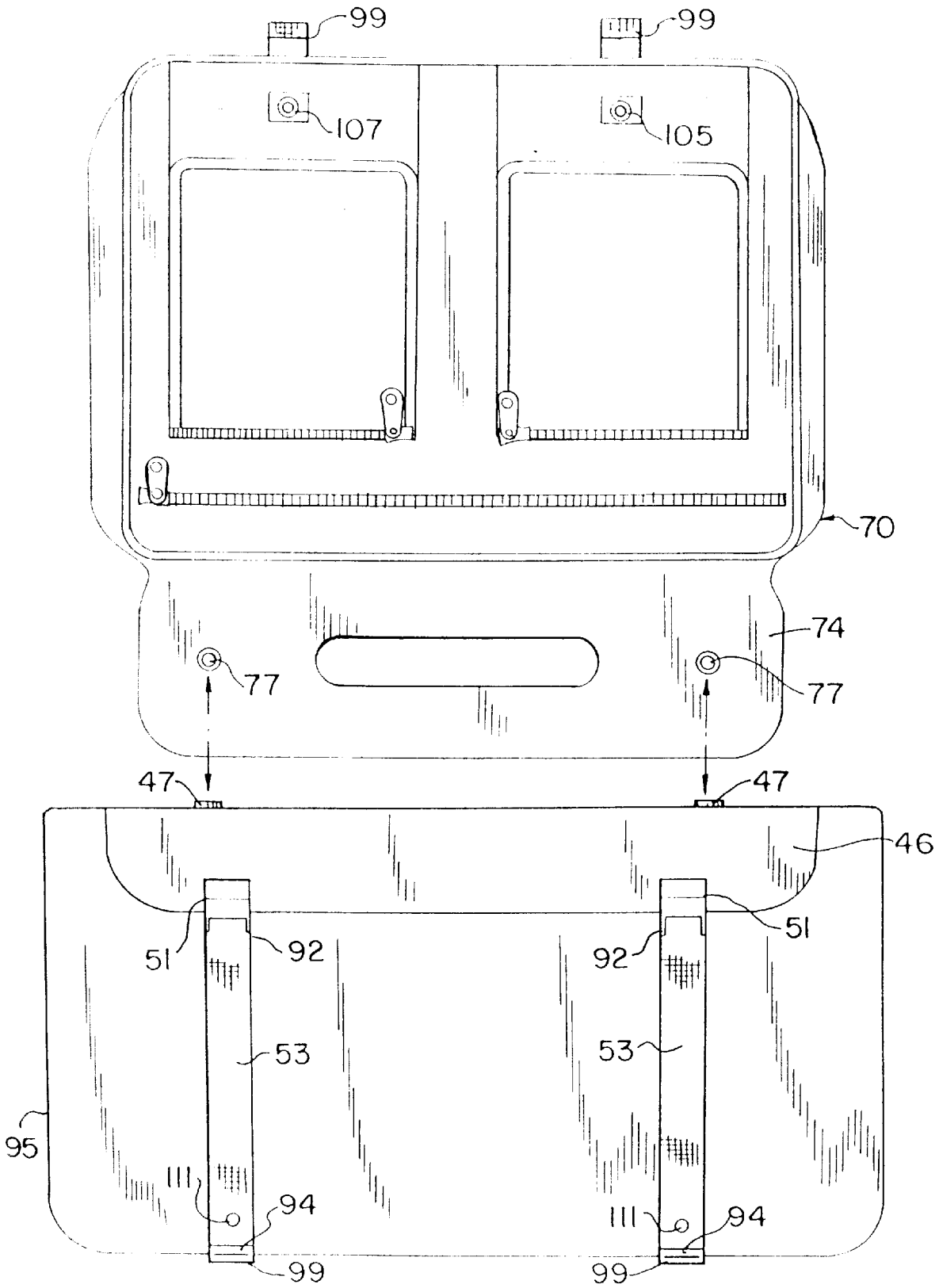

As shown in FIGS. 1–5, the top surface of each flap is provided with a snap-type fastening arrangement to removably secure the accessory bag with a second such bag coupled to it, in the manner to be shown in FIGS. 9 and 10. Shown as a pair of snaps (49 in FIGS. 1 and 5; 47 in FIGS. 10 and 7*b*; and 97 in FIG. 7*e*), such fastening arrangement may alternatively be one part of a hook-and-loop adhesion VELCRO system, the second part being on the underside surface of a comparable flap of the second accessory bag. Also shown in FIGS. 3–5 are respective buckles 99 extending from either the bottom wall 34 of the accessory bag, or from its side wall 36 to which the ends 94 of straps 53 attach to encircle around the bottom of the briefcase 10 in joining with a buckle-type closure 51 at the front of the flap, as illustrated in FIG. 5. The strap itself is shown at 53 joined between the two coupling elements in any appropriate manner.

Figure 6:
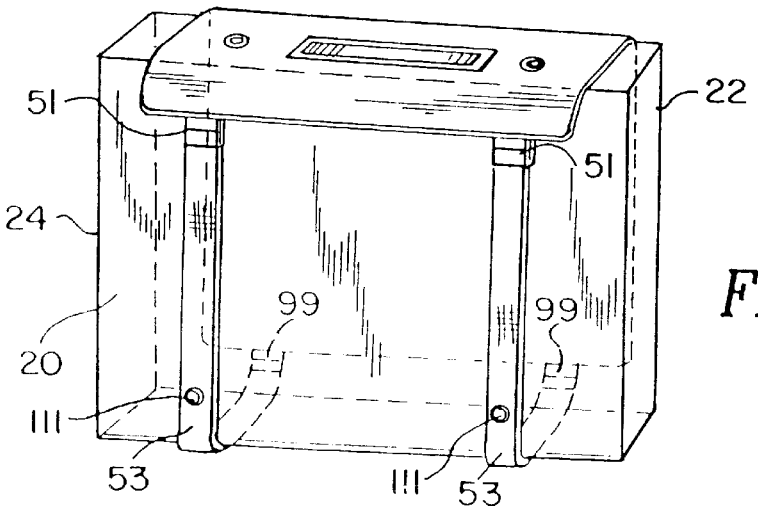
FIG. 6 shows, in partial phantom form, a rear view of a briefcase with an accessory bag embodying the invention strapped in position.

FIG. 6 illustrates the opposite view of FIG. 5, showing the straps 53 and the buckle arrangement 51 and 99, although it will be appreciated that similar depictions will be had for the accessory bag configurations of FIGS. 1–4, as well. Thus, FIG. 7*b* shows the strap securement of the accessory bag of FIG. 3 about the briefcase 10. The straps are again shown at 53, the buckle closure at 51 and 99, and the snaps 47 on top of the flap 46. As will be appreciated, whether the straps 53 are to be employed or not in securing the accessory bag with the briefcase is a question that is left for the user to decide. In a preferred embodiment, the straps 53 may be fabricated of a stretchable material so when attached by ends 94 to buckles 99 they can be pulled under and around the briefcase 10, to be brought up to join at ends 92 with the buckle closures 51. As indicated at 100 on the accessory bag of FIG. 3, a pair of foldable fabric handles, for example, may be provided, to allow the accessory bag to be carried by itself, detached from the briefcase after the straps 53 are separated. This is illustrated by the view of FIG. 9, showing the reverse side of the accessory bag 70, with additional expandable and zipperable compartments 101–103. The snaps 77 on the underside of flap 74 are intended to join in standard fashion with the receiving portions 47 on the top side of the flap 46 (FIG. 10) in conventional male-female manner.

FIGS. 7*a*, 7*b*, 9 and 10 illustrate how a typical accessory bag 70 may be coupled to a combined briefcase-bag arrangement, it being understood that at locations 113–115 at the top wall 72 of the bag 70, a pair of like, foldable fabric handles may be secured for separate carrying about of the bag 70 when desired. The accessory bag 70 includes its own flap 74, with its own elongated slot 76 to fit over the carry handle 12 of the briefcase 10. Similarly, the flap 74 has its own snaps or buckles 77 at its underside (as in FIG. 9) to join with the snaps 47 of the first flap 46, as indicated by the arrow notations C of FIGS. 7*a* and 7*b*. When thus carrying this out, the overall appearance of FIG. 8 is presented, with the two accessory bags shown, and with the carry handle 12 of the briefcase 10 extending through the elongated slots 48, 76, respectively.

Additional securement of the second accessory bag 70 with the accessory bag 95 and the briefcase 10 is had by virtue of the snaps 105, 107 extending from the bottom portion of the back of this second accessory bag 70, as shown in FIG. 9. To this end, FIGS. 7*c* and 7*d* show similar snaps placed on the straps 53, at the locations illustrated as 111 in FIG. 6. Understanding that the straps 53 are removable, the ends 92 in FIGS. 7*c* and 7*d* attach to the buckle 51 at the flap 46 and the ends 94 secure to the underside of the bag 95 at buckle 99 (FIGS. 6 and 10). Comparable attachments exist for the snaps 111 on the straps 53 with the snaps 105, 107 on the accessory bag 70 (FIG. 10), by similar male-female alignment, although in alternative embodiments VELCRO type hook-and-loop adhesion connections may be employed. Arrows D in FIGS. 7*a* and 7*b* show the securing of the second accessory bag 70 to the straps 53 in this manner, with FIG. 7*e* illustrating how the female portion 97 of a snap 77 receives the male portion 98 of the snap 47. The end result with the use of the optional straps 53 will thus be seen to be not only the detachable securement of the accessory bag 95 with the briefcase 10, but the added securement of the second accessory bag 70 with the briefcase 10 and with the accessory bag 95. In such manner, the carrying capacity of the standard briefcase is enhanced, for easily carrying about of the business traveler's personal computer, or the books, portfolios and other samples being received at the various meeting stops, and can be easily detached for separate carrying to meetings where it is not believed that the larger briefcase need be taken along. Where warranted, on the other hand, merely carrying the briefcase by its handle 12, in this manner, similarly carries along with it the two accessory bags at the same time.

With the preferred embodiment of the invention as thus set forth above, it will be seen that there becomes available a device constructed similar to the briefcase of vinyl, leather or other soft or hard material having one or more storage compartments with standard closure methods, and designed in such a way as to be carried or transported by simple placing over and affixing to the standard briefcase so as to be transported and carried as a unit along with the briefcase, attache case, small suitcase or overnight bag in conjunction with which it is used. As will also be seen, the arrangement allows an extension which would drape over the top of the standard briefcase or suitcase, and allow the bag's compartment(s) to hang to one side or the other of the briefcase or suitcase, while allowing access still to the handle in allowing everything to be carried about as a single unit. The straps will be seen to firmly secure the accessory bag, or bags, to the briefcase or suitcase, while allowing for their separate detachment to be carried about individually, as an alternative to being affixed as a composite unit with the briefcase or suitcase employed.

While there have been described what are considered to be preferred embodiments of the present invention, it will be readily appreciated by those skilled in the art that modifications can be made without departing from the scope of the teachings herein. For example, and as will be seen, in general, all of the bags described—regardless of the arrangement of their compartments—are of a similar design (with the same snaps, buckles, etc.) so that any one accessory bag can be strapped to the briefcase, attache case, small suitcase or overnight bag, and any other accessory bag can mate to it, or vice versa. Thus, the accessory bag 70 has all the snaps and buckles of the accessory bag 95 in identical locations. As will be appreciated it is the design of the straps 53 which allows one bag to be attached to the other as well as the snaps on top of the flaps shown. And, similarly, while the preferred embodiment of the invention includes a flap with an opening in it to allow access to the handle of the underlying briefcase, attache case, etc., an alternative configuration—also in accordance with the invention, although not as desirable —might be one in which the flap would not have an opening in it but would have its own handle, so that when attached to the briefcase, attache case, etc. by the straps, by holding on to the handle of the flap, the briefcase, attache case, etc. could be carried along with the accessory bag as in a sling. For at least such reasons, therefore, resort should be had to the claims appended hereto for a clear understanding of the scope of the invention.

I claim:

1. The combination comprising:

a briefcase of generally rectangular shape and substantial thickness having a carry handle and top, bottom, side and end walls;

an accessory bag also having top, bottom, side and end walls providing a carrying compartment for articles placed therein;

a flap extending from said top of said accessory bag having an opening therein of configuration to overlie and accept said carry handle when extended therethrough in abutting one of said side walls of said accessory bag against one of said side walls of said briefcase; and means on said flap and on one of said bottom and said one side wall of said accessory bag for removably securing said bag to said briefcase when carrying said briefcase about by said handle; and a handle on said top wall of said accessory bag for separately carrying said accessory bag about when removed from said briefcase.

2. The combination of claim 1, said flap opening including an elongated slot of configuration to receive and accept said carry handle.

3. The combination of claim 1, said means for removably securing said bag to said briefcase being on said flap and on said bottom wall of said accessory bag.

4. The combination of claim 3, said means including at least one strap extending from said flap.

5. The combination of claim 1, including fastening means on top and underside surfaces of said flap.

6. The combination of claim 5, said fastening means including snap and buckle means on respective opposite sides of said flap.

7. The combination of claim 1, including fastening means on said opposite side walls of said accessory bag.

8. The combination of claim 1, said accessory bag providing a single storage compartment for articles placed therein.

9. The combination of claim 1, said accessory bag providing a pair of storage compartments for articles placed therein.

10. The combination of claim 1, said means including at least one strap extending from said flap.

11. The combination of claim 1, said accessory bag having a zipperably openable top wall.

12. The combination of claim 1, said accessory bag having a claspably openable top wall.

13. The combination of claim 1 wherein said handle on said top wall of said accessory bag includes a pair of foldable fabric handles.

14. The combination comprising:

a briefcase of generally rectangular shape and substantial thickness having a carry handle and top, bottom, side and end walls;

a first accessory bag having top, bottom, side and end walls providing a first carrying compartment for articles placed therein;

a first flap extending from said top of said first accessory bag having a first elongated slot therein of configuration to overlie and accept said carry handle when extended therethrough in abutting one of said side walls of said accessory bag against one of said side walls of said briefcase;

a second accessory bag having top, bottom, side and end walls providing a second carrying compartment for articles placed therein;

a second flap extending from said top of said second accessory bag having a second elongated slot therein of configuration to overlie and accept said carry handle when extending therethrough, in abutting one of said side walls of said second accessory bag against the other of said side walls of said briefcase;

first means on said first flap and on one of said bottom and said one of said side walls of said first accessory bag for removably securing said first accessory bag to said briefcase when carrying said briefcase about by said handle;

second means on said second flap and on one of said bottom and said one side wall of said second accessory bag for removably securing said second accessory bag to said briefcase and to said first accessory bag when carrying said briefcase about by said handle; and a handle on said top wall of each of said first and second accessory bags for separately carrying either or both of said first and second accessory bags about when removed from said briefcase.

15. The combination of claim 14, including first fastening means on top and underside surfaces of said first flap and second fastening means on an underside surface of said second flap.

16. The combination comprising:

a briefcase of generally rectangular shape and substantial thickness having a carry handle and top, bottom, side and end walls;

an accessory bag having top, bottom, side and end walls providing a carrying compartment for articles placed therein;

a flap extending from said top of said accessory bag having an elongated slot therein of configuration to overlie and accept said carry handle when extended therethrough in abutting one of said side walls of said accessory bag against one of said side walls of said briefcase; and a handle on said top wall of said accessory bag for separately carrying said accessory bag about apart from said briefcase.

17. The combination comprising:

a briefcase of generally rectangular shape and substantial thickness having a carry handle and top, bottom, side and end walls;

a first accessory bag having top, bottom, side and end walls providing a first carrying compartment for articles placed therein;

a first flap extending from said top of said first accessory bag having a first elongated slot therein of configuration to overlie and accept said carry handle when extended therethrough in abutting one of said side walls of said accessory bag against one of said side walls of said briefcase;

a second accessory bag having top, bottom, side and end walls providing a second carrying compartment for articles placed therein; and a second flap extending from said top of said second accessory bag having a second elongated slot therein of configuration to overlie and accept said carry handle when extending therethrough, in abutting one of said side walls of said second accessory bag against the other of said side walls of said briefcase abutting one of said side walls of said accessory bag against one of said side walls of said briefcase; and a handle on said top wall of each of said first and second accessory bags for separately carrying either of said accessory bags about apart from said briefcase.

18. The combination of claim 17 wherein said handles on each of said first and second accessory bags include a pair of foldable fabric handles.

19. An accessory bag providing a carrying compartment for articles placed therein and to be removably secured with a briefcase having a carry handle, said accessory bag comprising:

top, bottom, side and end walls;

a flap extending from said top of said accessory bag having an elongated slot therein of configuration to overlie and accept said carry handle of said briefcase when extended therethrough in abutting a side wall of said accessory bag against said briefcase; and a handle on said top wall of accessory bag for separately carrying said accessory bag about separate from said briefcase.

* * * * *